US007463207B1

(12) United States Patent
Rao et al.

(10) Patent No.: US 7,463,207 B1
(45) Date of Patent: Dec. 9, 2008

(54) HIGH-EFFICIENCY HORNS FOR AN ANTENNA SYSTEM

(75) Inventors: Sudhakar Rao, Churchville, PA (US); Mihn Tang, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/594,157

(22) Filed: Nov. 8, 2006

Related U.S. Application Data

(63) Continuation-in-part of application No. 11/029,390, filed on Jan. 6, 2005, now abandoned.

(60) Provisional application No. 60/622,785, filed on Oct. 29, 2004.

(51) Int. Cl.
*H01Q 13/00* (2006.01)

(52) U.S. Cl. ..... 343/786; 343/783; 343/779

(58) Field of Classification Search ..... 343/786, 343/779, 781 R, 783, 776
See application file for complete search history.

(56) References Cited

U.S. PATENT DOCUMENTS

| | | | | |
|---|---|---|---|---|
| 3,662,393 | A * | 5/1972 | Cohn | 343/786 |
| 4,792,814 | A * | 12/1988 | Ebisui | 343/786 |
| 5,117,240 | A | 5/1992 | Anderson et al. | |
| 5,166,698 | A | 11/1992 | Ashbaugh et al. | |
| 6,084,552 | A | 7/2000 | Robertson et al. | |
| 6,366,256 | B1 * | 4/2002 | Ramanujam et al. | 343/781 CA |
| 6,384,795 | B1 * | 5/2002 | Bhattacharyya et al. | 343/786 |
| 6,396,453 | B2 | 5/2002 | Amyotte et al. | |
| 6,441,795 | B1 | 8/2002 | Volman | |
| 6,522,306 | B1 | 2/2003 | Parrikar et al. | |
| 6,642,900 | B2 * | 11/2003 | Bhattacharyya et al. | 343/786 |
| 7,183,991 | B2 * | 2/2007 | Bhattacharyya et al. | 343/786 |
| 2002/0000945 | A1 * | 1/2002 | Amyotte et al. | 343/786 |

* cited by examiner

*Primary Examiner*—Hoang V Nguyen
(74) *Attorney, Agent, or Firm*—McDermott Will & Emery LLP

(57) ABSTRACT

A multiple-beam antenna system includes at least one reflector and a cluster of horns for feeding the reflector. A horn of the cluster of horns is configured for providing transmission and reception of signals over respective transmission and reception frequency bands. The horn includes a substantially conical wall having an internal surface with a variable slope. The internal surface of the substantially conical wall includes slope discontinuities. At least one of the slope discontinuities has a diameter greater than 1.7 times the wavelength of the lowest frequency of the transmission frequency band. The diameter is also greater than 1.7 times the wavelength of the highest frequency of the transmission frequency band. In addition, the diameter is greater than 1.7 times the wavelength of the lowest frequency of the reception frequency band, and the diameter is greater than 1.7 times the wavelength of the highest frequency of the reception frequency band. This configuration of the slope discontinuity generates one or more higher order modes of a transverse electric (TE) mode over the transmission and reception frequency bands without generating a transverse magnetic (TM) mode.

26 Claims, 13 Drawing Sheets

HIGH-EFFICIENCY HORNS FOR AN ANTENNA SYSTEM

This is a continuation-in-part of U.S. patent application Ser. No. 11/029,390 entitled "MULTIPLE-BEAM ANTENNA SYSTEM USING HIGH-EFFICIENCY DUAL-BAND FEED HORNS," filed on Jan. 6, 2005, which claims the benefit of priority under 35 U.S.C. §119 from U.S. Provisional Patent Application Ser. No. 60/622,785 entitled "MULTIPLE-BEAM ANTENNA USING HIGH-EFFICIENCY DUAL-BAND HORNS," filed on Oct. 29, 2004, all of which are hereby incorporated by reference in their entirety for all purposes.

FIELD OF THE INVENTION

The present invention relates to horns and antennas, and particularly, to high-efficiency horns utilized in a multiple-beam antenna (MBA) system for providing transverse electric (TE) modes of electromagnetic waves.

BACKGROUND ART

Over the last few years, there has been a tremendous growth in the use of multiple-beam antenna systems for satellite communications. For example, multiple-beam antennas are currently being used for direct-broadcast satellites (DBS), personal communication satellites (PCS), military communication satellites, and high-speed Internet applications. These antennas provide mostly contiguous coverage over a specified field of view on Earth by using high-gain multiple spot beams for downlink (satellite-to-ground) and uplink (ground-to-satellite) coverage.

Conventional multiple-beam satellite payloads employ separate uplink and downlink antenna suites. For example, the Anik-F2 satellite uses 5 uplink antennas in one antenna suite and 5 downlink antennas in another antenna suite, requiring 10 apertures. In addition, twice the number of feed horns is required. This is due to the lack of thin-walled feed horn that could efficiently support both uplink and downlink frequencies that are widely separated. Each feed horn in the downlink antenna suit is capable of providing signal transmission over a selected transmission frequency band, whereas each feed horn in the uplink antenna suit is configured to provide signal reception over a required reception frequency band. These conventional multibeam satellites require several antenna apertures limiting the available real estate on the spacecraft for other payload antennas and are relatively expensive due to twice the number of reflectors and twice the number of feed horns required when compared to the dual-band antenna system disclosed herein. Other conventional multiple-beam satellite payloads, such as AMC-15, AMC-16 and Rainbow, employ dual-band antennas using low-efficiency corrugated feed horns to realize dual-band operation, but have a significantly lower RF performance.

Therefore, there is a need to provide multiple spot beam coverage at both uplink and downlink frequency bands using dual-band feed horns with each horn forming congruent beams at both uplink and downlink frequency bands. That means that the horn needs to cover frequency bands that are widely separated, for example, 20 GHz and 30 GHz frequency bands. In addition, it is desirable to provide high horn efficiency, e.g. higher than 80%, at both frequency bands in order to (a) reduce the spillover losses, (b) improve the coverage gain and (c) improve the copolar isolation among beams that reuse the same frequency channels.

SUMMARY OF THE DISCLOSURE

According to one embodiment, the present invention offers a novel multiple-beam antenna system having multiple reflectors, each of which supports both transmission and reception of signals. A cluster of high-efficiency horns is provided for feeding each of the reflectors. The horns are designed for providing signal transmission and reception over widely separated respective transmission and reception frequency bands.

In accordance with one aspect of the present invention, the horn includes a substantially conical wall that flares from the throat section of the horn to the horn aperture and has an internal surface with a variable slope. The internal surface of the substantially conical wall has a number of slope discontinuities configured for generating desired higher order modes over the transmission and reception frequency bands.

In accordance with another aspect of the present invention, a diameter of the throat section is selected to allow the throat section to generate and propagate only the dominant mode over the transmission frequency band.

In accordance with a further aspect of the present invention, the substantially conical wall contains a phasing section having a permanent slope. The phasing section is configured to ensure that all modes add in a proper phase relationship with the dominant mode at the aperture.

According to one aspect of the present invention, the internal surface of the substantially conical wall is free from recesses, flares or corrugations all the way from the throat section to the aperture to maintain high horn efficiency over widely separated transmission and reception frequency bands.

According to one aspect of the present invention, a multiple-beam antenna system includes at least one reflector and a cluster of horns for feeding the reflector. A horn of the cluster of horns is configured for providing transmission and reception of signals over respective transmission and reception frequency bands. The horn includes a substantially conical wall having an internal surface with a variable slope. The internal surface of the substantially conical wall includes a plurality of slope discontinuities. At least one of the plurality of slope discontinuities has a diameter greater than 1.7 times the wavelength of the lowest frequency of the transmission frequency band. The diameter is also greater than 1.7 times the wavelength of the highest frequency of the transmission frequency band. In addition, the diameter is greater than 1.7 times the wavelength of the lowest frequency of the reception frequency band, and the diameter is greater than 1.7 times the wavelength of the highest frequency of the reception frequency band. This configuration of the slope discontinuity generates one or more higher order modes of a transverse electric (TE) mode over the transmission and reception frequency bands without generating a transverse magnetic (TM) mode.

According to one aspect of the present invention, a horn for feeding an antenna reflector is configured to provide transmission and reception of signals over respective transmission and reception frequency bands. The horn includes a substantially conical wall having an internal surface with a variable slope. The internal surface of the substantially conical wall includes one or more slope discontinuities. At least one of the one or more slope discontinuities has a diameter greater than 1.7 times the wavelength of the lowest frequency of the transmission frequency band. The diameter is also greater than 1.7 times the wavelength of the highest frequency of the transmission frequency band. In addition, the diameter is greater than 1.7 times the wavelength of the lowest frequency of the reception frequency band, and the diameter is greater than 1.7 times the wavelength of the highest frequency of the reception frequency band. This configuration of the slope discontinuity generates one or more higher order modes of a transverse electric (TE) mode over the transmission and reception frequency bands without generating a transverse magnetic (TM) mode.

According to one aspect of the present invention, a horn for an antenna system is configured to generate a dominant mode of a TE mode of an electromagnetic wave and one or more higher order modes of the TE mode without generating a TM mode. The horn includes a first opening located at a first end and a first region connected to the first opening. The first region includes a first internal surface. The first region is configured to generate only the dominant mode of the TE mode. The horn also includes a second region connected to the first region. The second region includes a second internal surface. The second region is configured to generate the dominant mode of the TE mode and one or more higher order modes of the TE mode without generating the TM mode. In addition, the horn includes a second opening located at a second end opposite to the first end. The second opening is connected to the second region. The horn has a length along an axis extending between the first opening and the second opening. The second internal surface of the second region includes one or more tapered surface regions. Each of the one or more tapered surface regions has a slope greater than zero and less than ninety degrees with respect to the axis. The second internal surface of the second region lacks any flat surface region having a zero slope with respect to the axis.

According to one aspect of the present invention, a horn for an antenna system is configured to generate a dominant mode of a TE mode of an electromagnetic wave and one or more higher order modes of the TE mode without generating a TM mode. The horn includes a first opening located at a first end and a first region connected to the first opening. The first region includes a first internal surface. The first region is configured to generate the dominant mode of the TE mode. The horn also includes a second region connected to the first region. The second region includes a second internal surface. The second region is configured to generate one or more higher order modes of the TE mode without generating the TM mode. In addition, the horn includes a second opening located at a second end opposite to the first end. The second opening is connected to the second region. The horn has a length along an axis extending between the first opening and the second opening. The second internal surface of the second region includes a plurality of tapered surface regions. A first one of the plurality of tapered surface regions is connected to a next one of the plurality of tapered surface regions. Each of the plurality of tapered surface regions has a different slope with respect to the axis. A last one of the plurality of tapered surface regions is connected to the second opening. The last one of the plurality of tapered surface regions has the smallest slope with respect to the axis among all of the plurality of tapered surface regions.

Additional advantages and aspects of the present invention will become readily apparent to those skilled in the art from the following detailed description, wherein embodiments of the present invention are shown and described, simply by way of illustration of the best mode contemplated for practicing the present invention. As will be described, the invention is capable of other and different embodiments, and its several details are susceptible of modification in various obvious respects, all without departing from the spirit of the invention. Accordingly, the drawings and description are to be regarded as illustrative in nature, and not as limitative.

BRIEF DESCRIPTION OF THE DRAWINGS

The following detailed description of the embodiments of the present invention can best be understood when read in conjunction with the following drawings, in which the features are not necessarily drawn to scale but rather are drawn as to best illustrate the pertinent features, wherein:

FIG. 2(*a*) is applicable to smaller reflectors or larger beams while FIG. 2(*b*) is applicable to larger reflector or smaller beams.

DETAILED DISCLOSURE OF THE EMBODIMENTS

The present disclosure is made with an example of a four-aperture antenna system with a cluster of feeds associated with each reflector. It will become apparent, however, that the concepts described herein are applicable to an antenna system having any number of reflectors and any arrangement of feeds.

Figure 1:
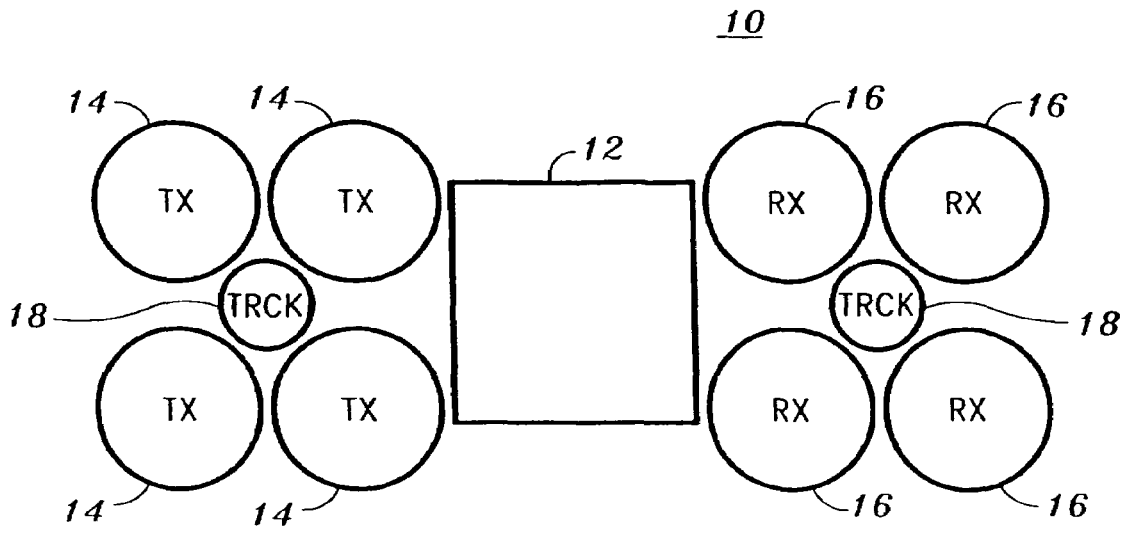
FIG. 1 illustrates a conventional multiple-beam antenna (MBA) system having reflectors that support either transmission or reception of signals.

FIG. 1 illustrates a conventional multiple-beam antenna system 10 including ten reflectors mounted on a spacecraft body 12. The reflectors of the antenna system 10 include four transmit reflectors 14, four receive reflectors 16 and two track reflectors 18. Each of the reflectors is illuminated with a cluster of feed horns (not shown). As the reflectors 14 and 16 provides signal communication over a single transmission or reception frequency band, the feed horns associated with the respective reflectors have to support transmission or reception only over a single frequency band. For example, U.S. Pat. Nos. 6,384,795 and 6,396,453 disclose single-band feed horns suitable to support transmission or reception for the conventional antenna system 10.

Figure 2A:
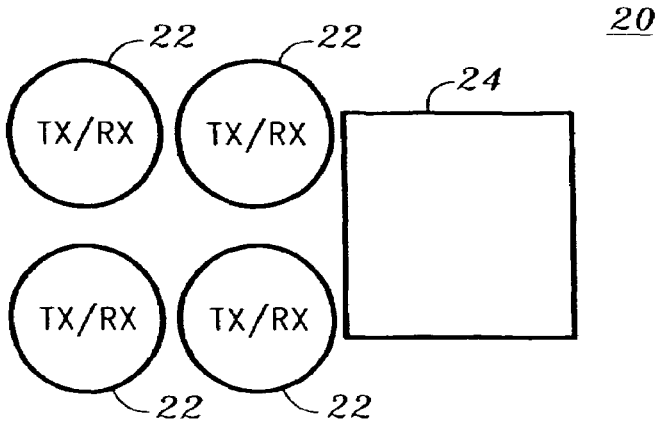
FIGS. 2(*a*) and 2(*b*) illustrates two possible packaging concepts of the reflector antennas on the spacecraft for a multiple-beam antenna suit of the present invention, in which each reflector supports both transmission and reception of signals in accordance with one embodiment of the present invention.
Figure 2B:
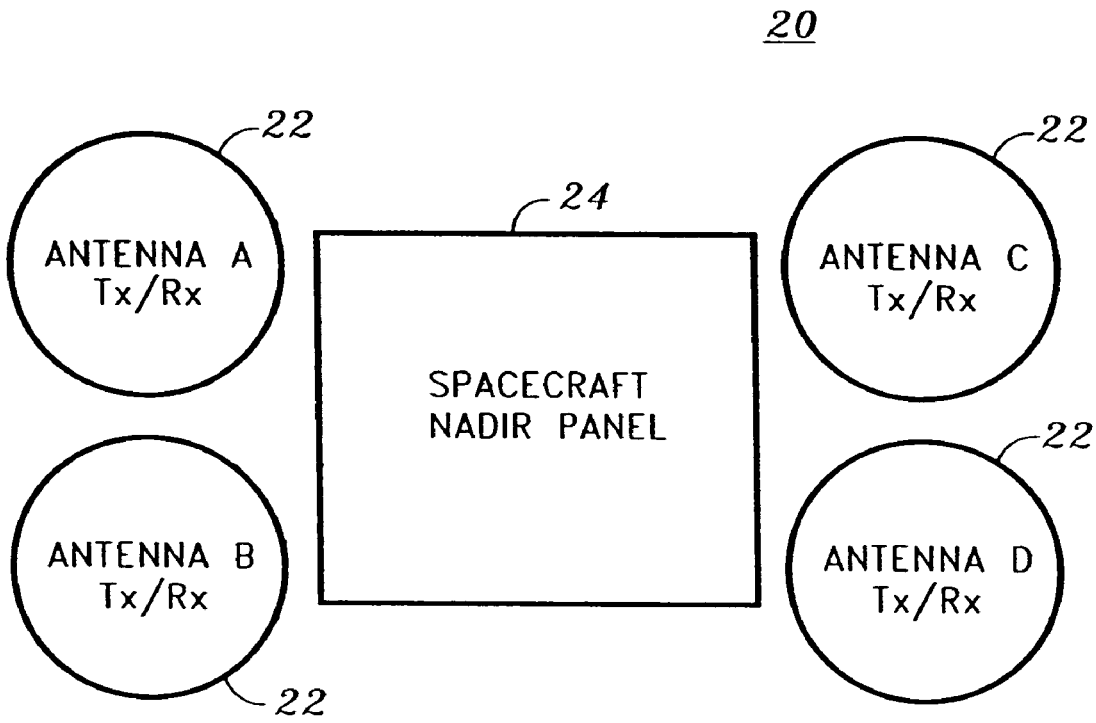

FIGS. 2(*a*) and 2(*b*) illustrates two possible packaging concepts of the reflector antennas on the spacecraft for a multiple-beam antenna suit of the present invention, in which each reflector supports both transmission and reception of signals. FIG. 2(*a*) is applicable to smaller reflectors or larger beams, while FIG. 2(*b*) is applicable to larger reflector or smaller beams. As illustrated in FIGS. 2(*a*) and 2(*b*), a multiple-beam antenna system 20 of the present invention includes only four reflectors 22 mounted on a spacecraft body 24. Each of the reflectors 22 provides transmission and reception of signals over widely separated transmission and reception frequency bands. For example, a frequency band from 18. 3 GHz to 20.2 GHz may be used for transmission, and a frequency band from 28.3 GHz to 30.0 GHz may be employed for reception. A cluster of feed horns (not shown) is associated with each of the reflectors to illuminate the respective reflector.

Hence, the antenna system 20 of the present invention needs 4 apertures instead of 10, and, therefore, requires a significantly smaller number of horn feeds for illuminating the reflectors. Accordingly, the antenna system 20 offers significant cost and mass savings, and 50% savings in real estate compared to the conventional system 10.

Each of the feed horns of the antenna system 20 has to support transmission and reception of signals over widely separated transmission and reception frequency bands. As discussed in more detail below, geometry of the feed horns in the antenna system 20 is synthesized to include slope discontinuities that provide high horn efficiency, e.g. 85% to 90%, over both transmission and reception frequency bands in order to (a) reduce the spillover losses, (b) improve the coverage gain and (c) improve the copolar isolation.

Figure 5:
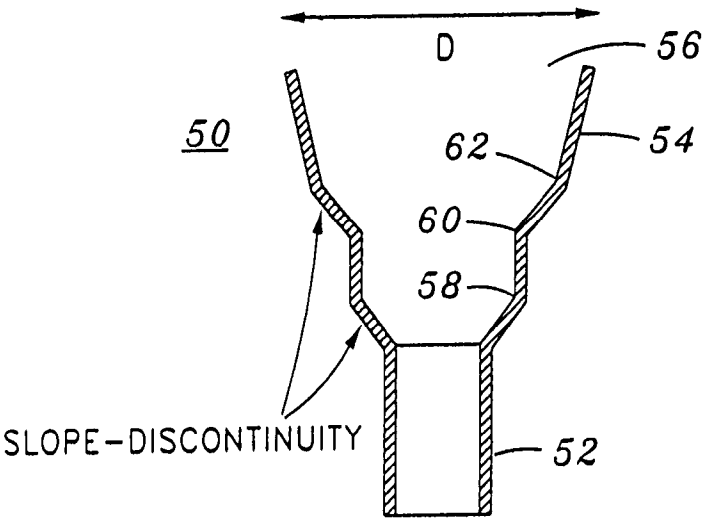
FIG. 5 illustrates a dual-band feed horn of the present invention having slope discontinuities according to one embodiment of the present invention.
Figure 4:
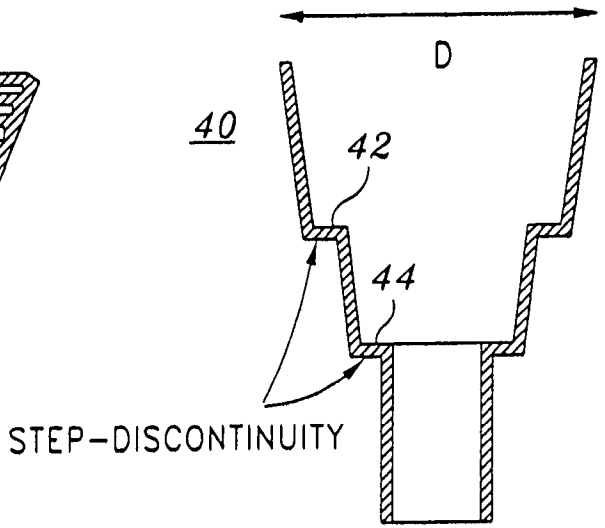
FIG. 4 illustrates a conventional single-band feed horn with step-discontinuities.
Figure 3:
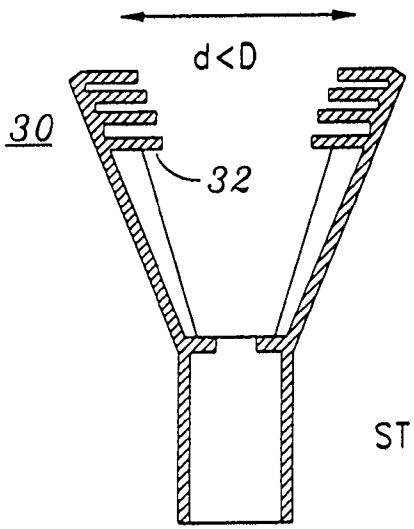
FIG. 3 illustrates a conventional corrugated dual-band feed horn.

FIGS. 3-5 illustrate different types of feed horn geometry. In particular, FIG. 3 shows a conventional corrugated feed horn 30. Although such a horn supports dual-band communications, it has low efficiency (about 54%) due to corrugations 32 on the internal surface. In addition, the corrugated feed horn is heavy and bulky.

FIG. 4 shows a conventional single-band feed horn 40 with step-discontinuities. Whereas such a horn has high efficiency, it supports transmission or reception only in a narrow bandwidth due to steps 42 and 44 on the internal surface.

FIG. 5 illustrates a feed horn 50 in the antenna system 20 of the present invention. The feed horn 50 has a throat section 52 and a substantially conical wall 54 that flares from the throat section 52 to an aperture 56. The internal surface of the conical wall has a variable slope with slope discontinuities 58, and 60 and 62 at points where the slope changes. As discussed in more detail below, different numbers of slope discontinuities may be provided on the internal surface of the conical wall 54 depending on the aperture size and overall bandwidth required. The slope discontinuities are provided to broaden bandwidth and improve the horn efficiency over very wide bandwidths to support transmission and reception over widely separated transmission and reception frequency bands. In addition, the feed horn using slope discontinuities is about 50% lighter than the conventional corrugated feed horn.

Figure 6:
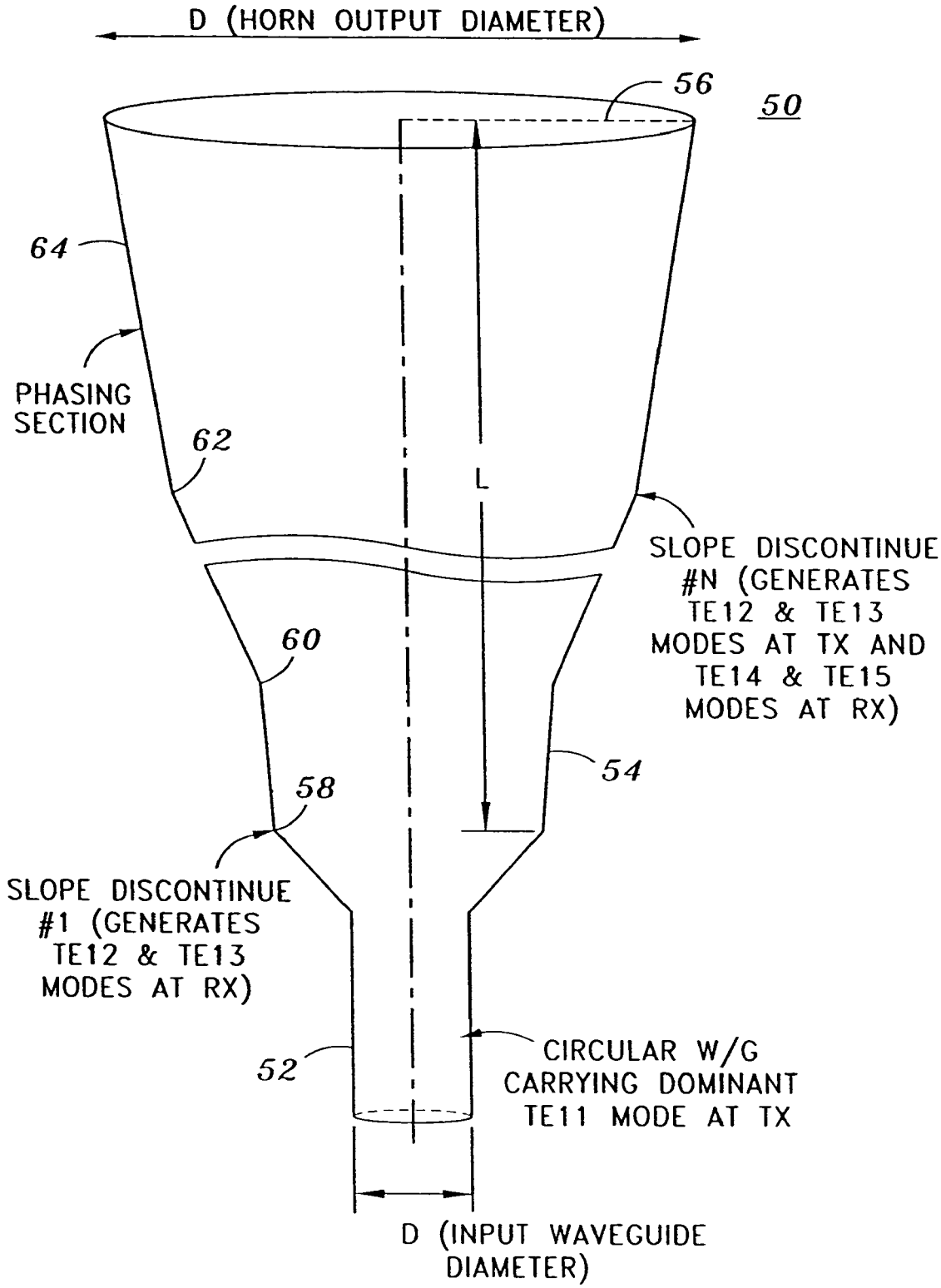
FIG. 6 illustrates a mechanism of generating desired higher order modes using the slope discontinuities according to one embodiment of the present invention.

Improvement of the horn efficiency and reduction of the cross-polar levels may be achieved by exciting and controlling the higher order modes in the horn. FIG. 6 illustrates a mechanism for generating desired higher order modes using slope discontinuities within the horn 50. The diameter d of the throat section 52 is selected such that the throat section propagates only the dominant mode of the transverse electric (TE) mode, the TE11 mode, at the downlink, i.e. over the transmission frequency band. The diameter of the horn 50 is increased to value D at the aperture 56. An axial length L from the throat section 52 to the aperture 56 is selected to gradually taper the horn.

Finite number N of slope discontinuities is provided to generate the desired higher order modes. The number N of slope discontinuities depends on the aperture size and overall bandwidth required. For example, the first slope discontinuity 58 generates the TE12 & TE13 higher order modes at the uplink, i.e. over the reception frequency band. The N-th slope discontinuity 62 generates the TE12 and TE13 modes at the downlink, and also TE14 and TE15 modes at the uplink.

After the N-th slope discontinuity 62, the horn 50 contains a smooth phasing section 64 that flares from the N-th slope discontinuity 62 to the aperture 56. The phasing section 64 having a permanent slope is provided to ensure that all the modes add in a proper phase relationship with the dominant mode at the aperture 56.

A specific geometry of the horn 50 with slope discontinuities depends on the magnitude of the higher order modes relative to the dominant mode that needs to be generated. For example, the mode electric field amplitude distribution at downlink is 1.0, 0.31 and 0.22 for the TE11, TE12 and TE13 modes, respectively. The mode amplitude distribution for uplink is 1.0, 0.30, 0.19, 0.15 and 0.14 for the TE11, TE12, TE13, TE14 and TE15 modes, respectively. These distributions give a theoretical maximum efficiency of 94% at the downlink and 96% at the uplink. However, in practice, the efficiency value needs to be traded with horn return loss and cross-polar levels. Therefore, efficiency values in excess of 85% can be generally achieved.

By contrast with the horns shown in FIGS. 3 and 4, the internal surface of the wall 54 is free from recesses, flares or corrugations all the way from the throat section 52 to the aperture 56. Hence, higher horn efficiency is maintained over wide bandwidths to support transmission and reception over widely separated transmission and reception frequency bands.

Figure 7:
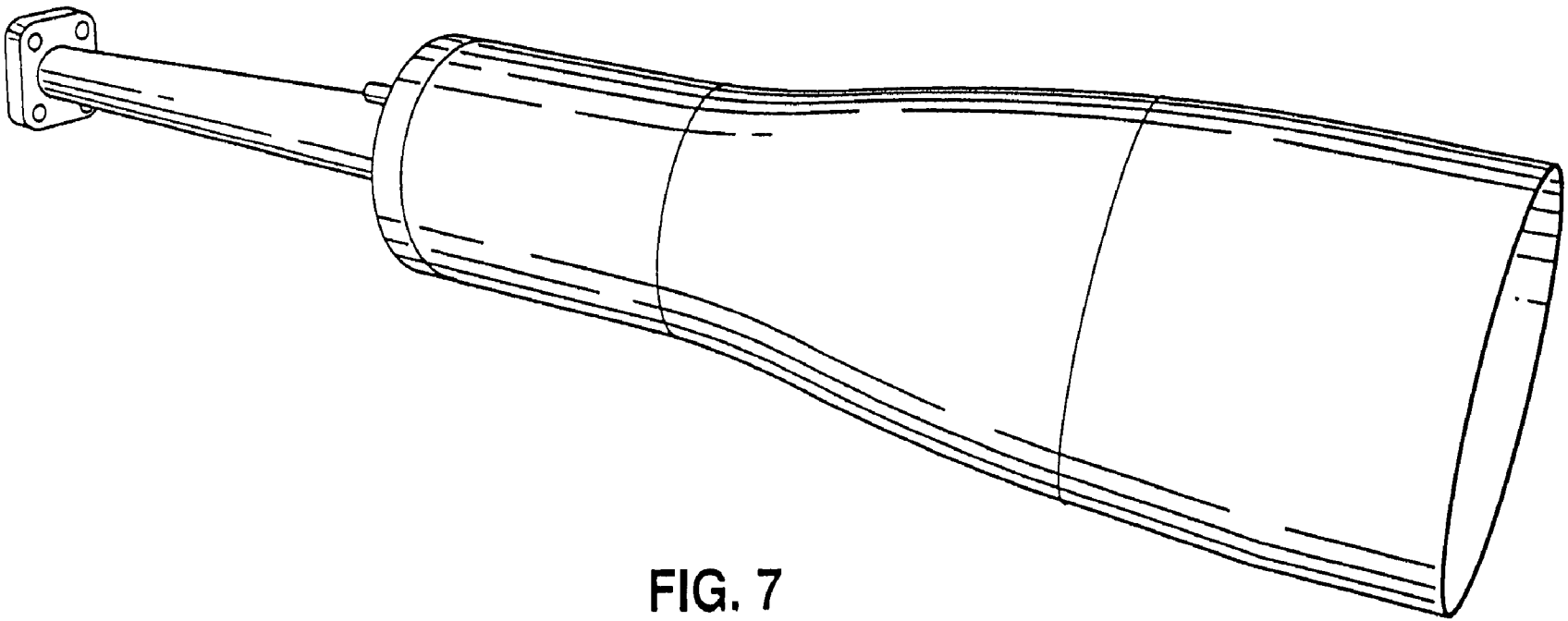
FIG. 7 shows the dual-band high efficiency horn (HEH) manufactured according to the principle described in FIG. 6.

FIG. 7 illustrates the dual-band high-efficiency horn (HEH) that was manufactured using several slope discontinuities as per the design principles described in FIG. 6. This horn has an aperture internal diameter of 2.27 in. and an axial length of 7.0 in.

Figure 8:
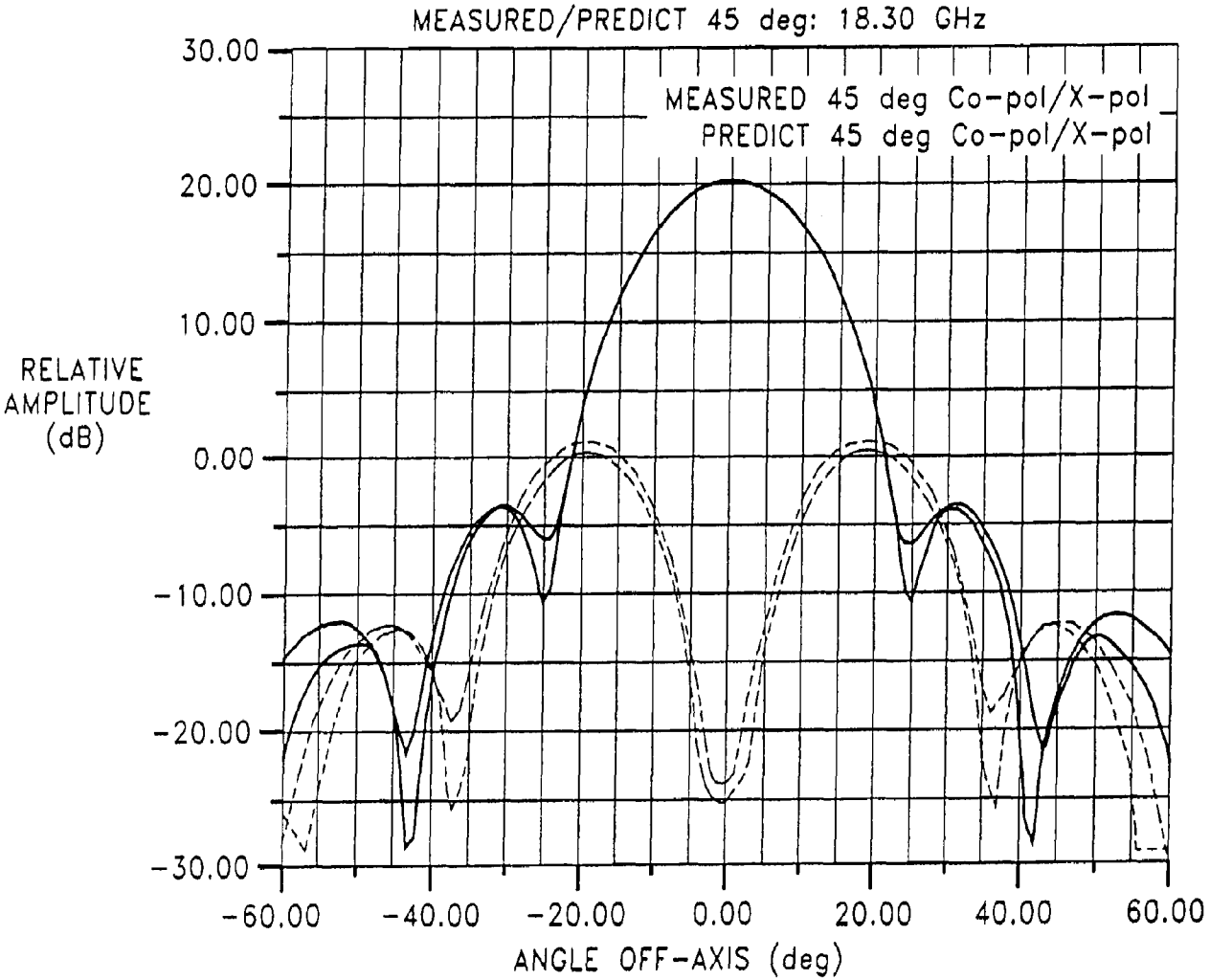
FIG. 8 shows the comparison results of the measured and computed radiation patterns of HEH at 18.3 GHz according to one aspect of the present invention.

FIG. 8 shows the comparison of the measured radiation patterns of the horn with computed patterns at 18.3 GHz. Both copolar and cross-polar radiation patterns of the horn are shown in the diagonal 45 deg. plane. Good agreement is noticed between the measured and computed patterns which validates the design principles used and the high efficiency achieved with the present invention at K-band frequencies.

Figure 9:
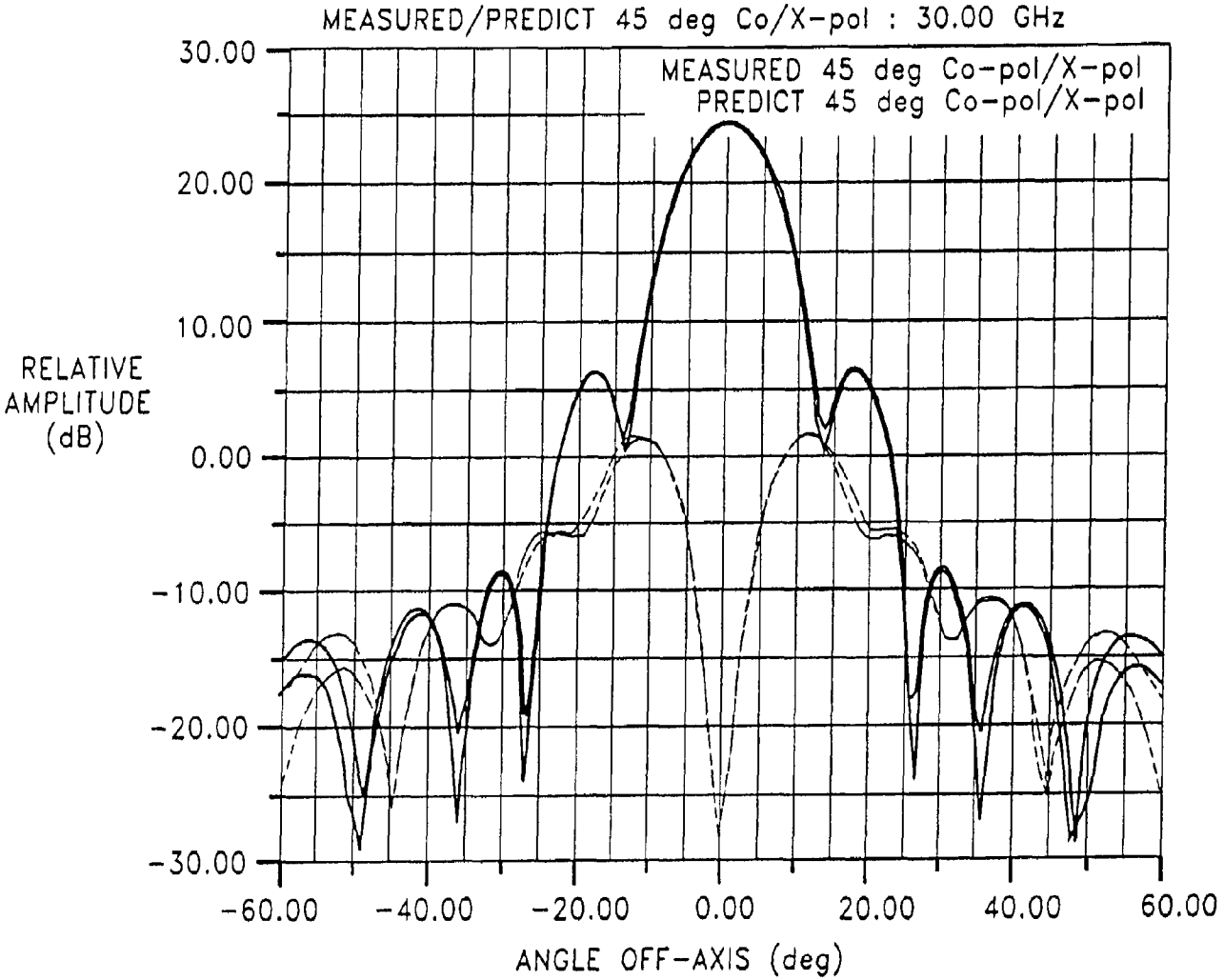
FIG. 9 shows the comparison results of the measured and computed radiation patterns of HEH at 30.0 GHz according to one aspect of the present invention.

FIG. 9 shows the comparison of the measured radiation patterns of the horn with computed patterns at 30.0 GHz. Both copolar and cross-polar radiation patterns of the horn are shown in the diagonal 45 deg. plane. Good agreement is noticed between the measured and computed patterns which validates the design principles used and the high efficiency achieved with the present invention at Ka-band frequencies.

Figure 10:
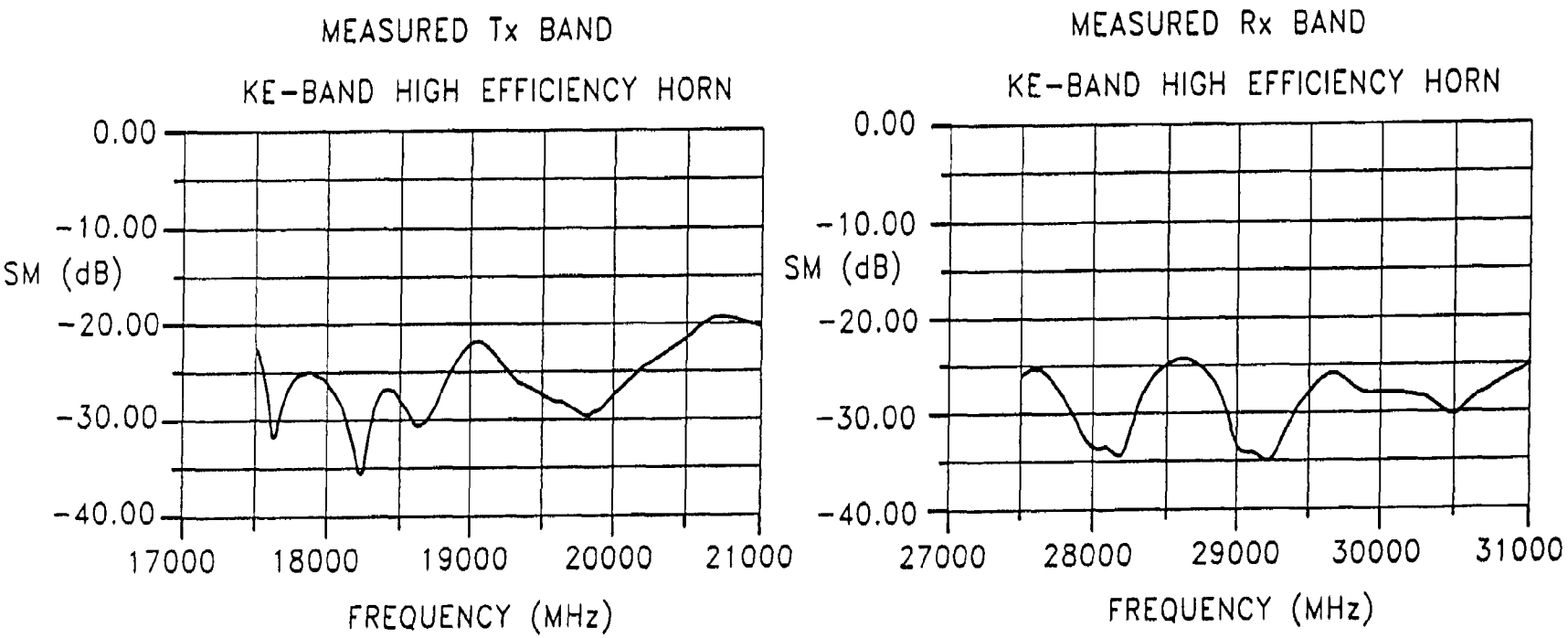
FIG. 10 shows the measured return loss of the HEH at both bands according to one aspect of the present invention.

FIG. 10 shows the measured return loss of the horn at both K and Ka band frequencies. Measured return loss is better than 22 dB over the designed frequencies. It shows that the mismatch from the slope discontinuities used is minimal and dual-band performance is achieved with the high-efficiency horn.

Figure 11:
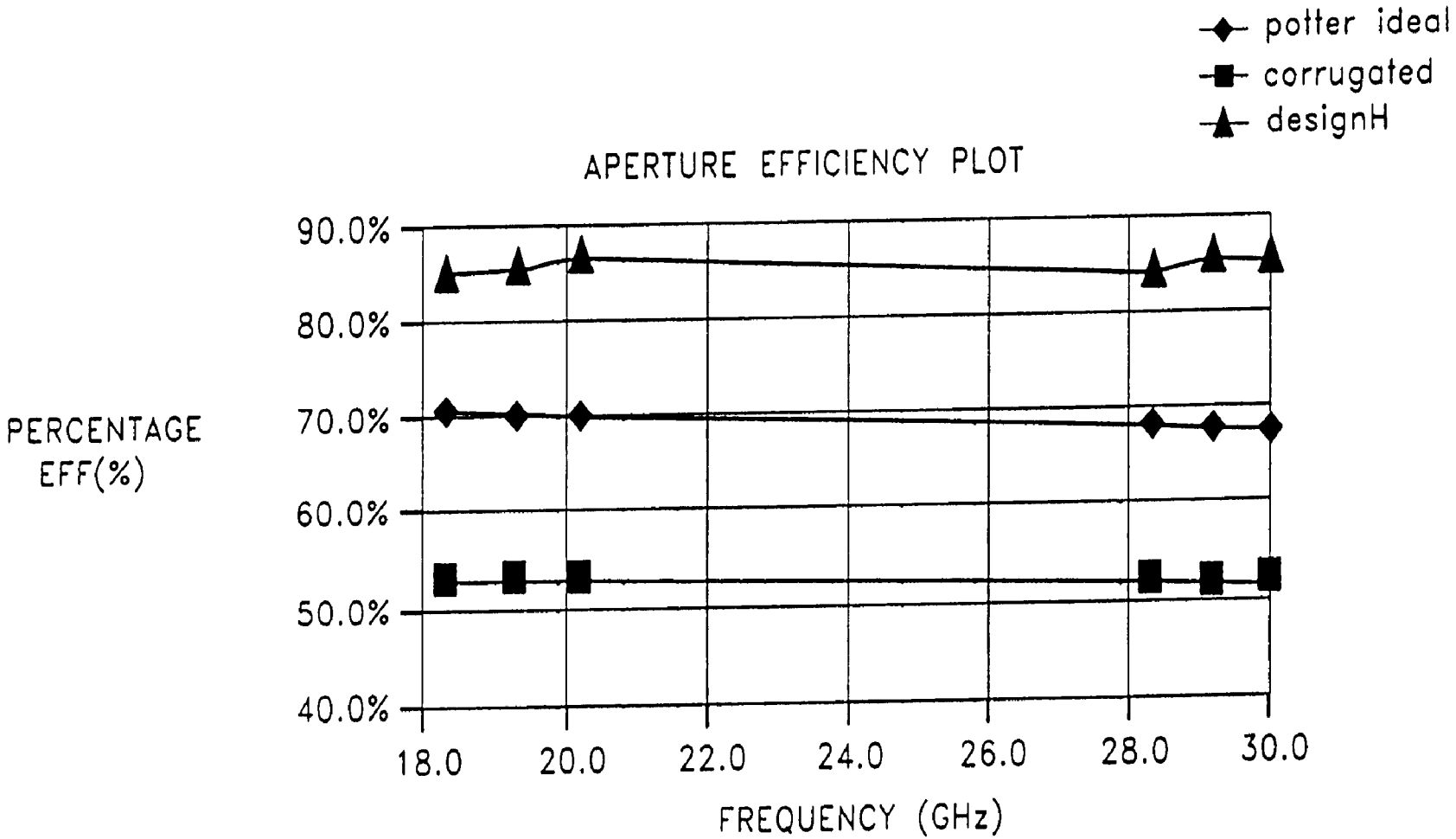
FIG. 11 shows aperture efficiency comparison of HEH with conventional horns.

FIG. 11 shows the aperture efficiency of the high-efficiency horn compared with two other conventional horn designs, namely the corrugated horn and ideal Potter horn. The figure shows significant increase in the aperture efficiency of the HEH when compared to the conventional horn designs at both bands. The corrugated horn has an aperture efficiency of about 52% over the bands, the ideal Potter horn has an aperture efficiency of about 68% over the bands and the HEH has an efficiency of about 85% over both bands.

Figure 12:
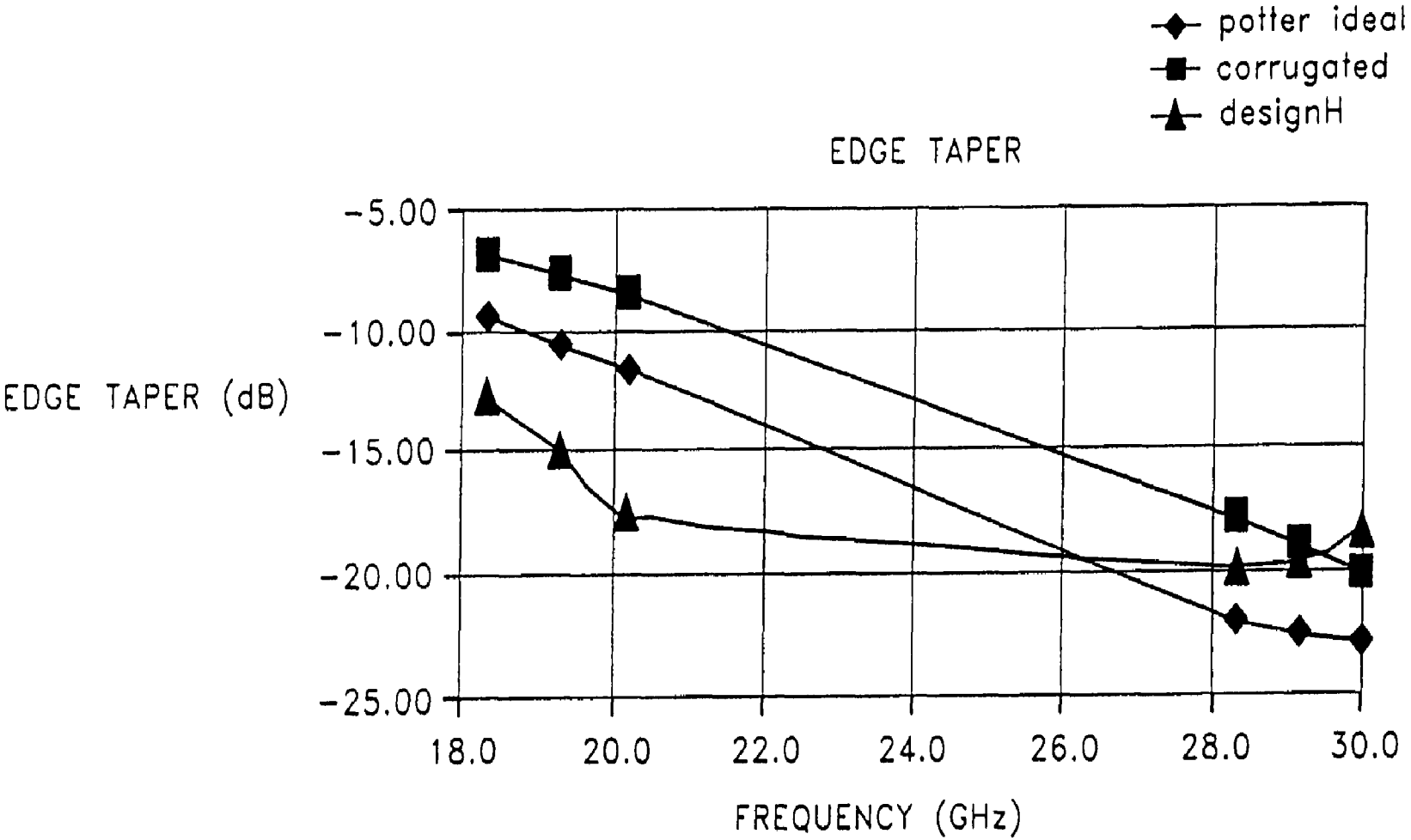
FIG. 12 shows comparison of feed illumination taper on the reflector due to different horn types.

FIG. 12 shows the edge illumination taper on the reflector of the high-efficiency horn compared with the corrugated horn and ideal Potter horn. The figure shows significant increase in the illumination taper at K-band of the HEH when compared to the conventional horn designs at both bands. The corrugated horn has a taper of about 6.5 dB at transmit, the ideal Potter horn has a taper of about 9 dB at transmit, while the HEH illuminates the reflector optimally with an illumination taper of 13 dB at transmit. All three designs give illumination taper of better than 17 dB at receive frequencies. The significant improvement in the transmit taper due to HEH results in better edge of coverage gain and better copolar isolation (C/I) at transmit frequencies.

Figure 13:
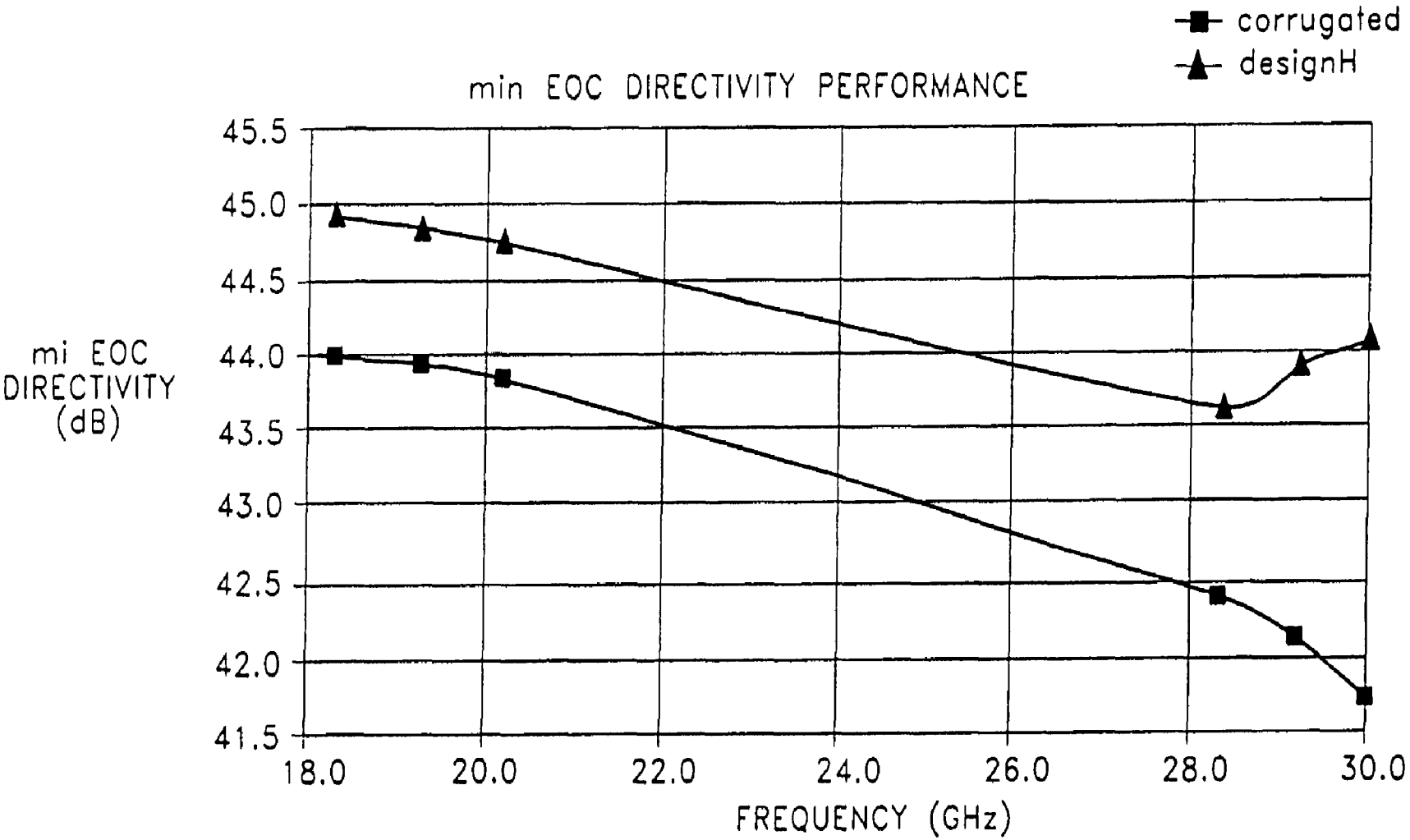
FIG. 13 shows comparison of minimum edge of coverage directivity of the reflector MBA due to HEH and conventional corrugated horn.

FIG. 13 shows comparison results of the minimum edge-of-coverage directivity over CONUS coverage of the MBA using HEH with that using conventional corrugated horns. The minimum directivity with HEH is about 0.9 dB more than with corrugated horn at transmit frequencies while the improvement is more than 1.5 dB at receive frequencies. These antenna directivity improvements result in spacecraft power savings of about 20% and G/T improvement of more than 1.5 dB. Overall communication link improvement with HEH is more than 2.5 dB.

Figure 14:
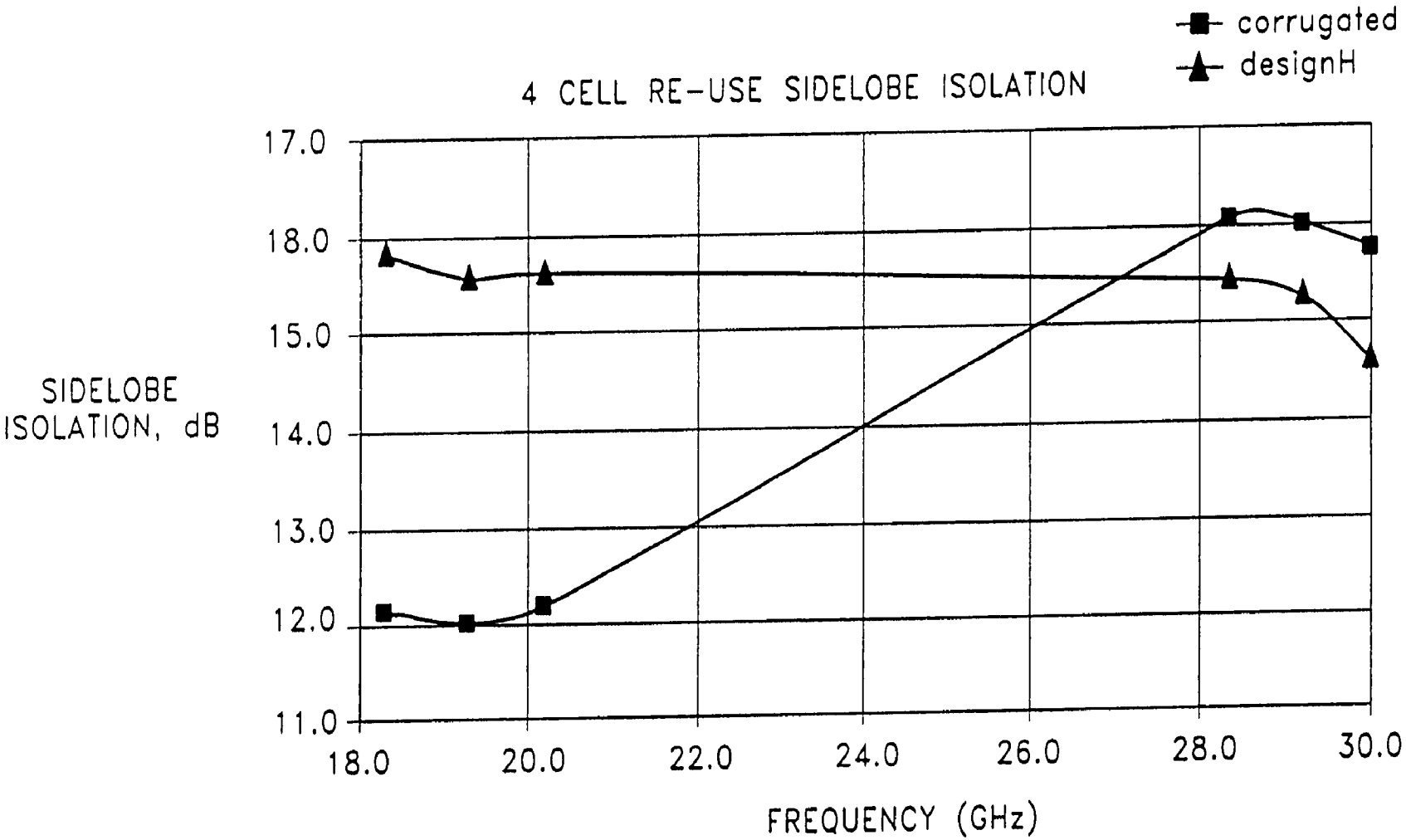
FIG. 14 shows comparison of copolar isolation (C/I) of the reflector MBA due to HEH and conventional corrugated horn.

FIG. 14 shows the comparison of copolar isolation (C/I) of the reflector MBA system using HEH with that using the corrugated horn. The copolar isolation for all the MBAs are limited at the transmit band and the improvement with HEH is about 4 dB over the corrugated horn. At receive the corrugated horn has slightly better C/I (about 0.7 dB on average) when compared to HEH, but the C/I is better than 14.5 dB with HEH.

Figure 15:
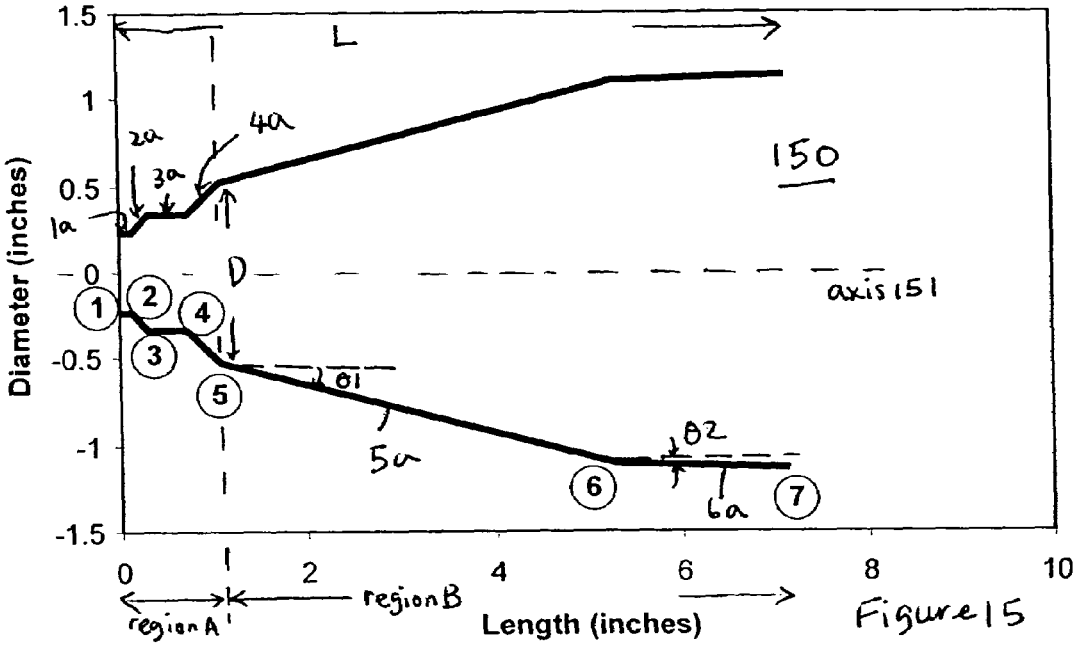
FIG. 15 illustrates a dual-band feed horn having slope discontinuities according to one embodiment of the present invention.

FIG. 15 illustrates a dual-band feed horn having slope discontinuities according to one embodiment of the present invention. A dual-band feed horn 150 is configured for providing transmission and reception of signals over respective transmission and reception frequency bands. The horn 150 includes a substantially conical wall having an internal surface with a variable slope.

The horn 150 includes a first opening at a throat 1 and a second opening at an aperture 7. It has a length along an axis 151 extending between the throat 1 and the aperture 7. The axis 151 is generally perpendicular to the cross-section of the horn 150. A length L between the throat 1 and the aperture 7 is shown, and a diameter D of the horn 150 is shown at a slope discontinuity 5.

Between the throat 1 and the aperture 7, the horn 150 includes region A connected to the first opening and region B connected to region A at one end and to the second opening at the other end.

Region A includes the throat 1, slope discontinuities 2, 3 and 4, a circular waveguide having a substantially flat surface region 1*a* between the throat 1 and the slope discontinuity 2, a circular waveguide having a tapered surface region 2*a* between the slope discontinuities 2 and 3, a circular waveguide having a substantially flat surface region 3*a* between the slope discontinuities 3 and 4, and a circular waveguide having a tapered surface region 4*a* between the slope discontinuities 4 and 5. Each of the flat surface regions 1*a* and 3*a* has substantially a zero slope with respect to the axis 151. Each of the tapered surface regions 2*a* and 4*a* has a slope greater than zero and less than ninety degrees with respect to the axis 151.

Region A generates the dominant mode of TE11. Region A, however, does not generate the higher order modes of the TE mode (e.g., the TE12 mode, the TE13 mode, the TE14 mode, the TE15 mode, the TE16 mode, the TE17 mode, etc.).

Region B includes slope discontinuities 5 and 6, the aperture 7, a circular waveguide having a tapered surface region 5*a* between the slope discontinuities 5 and 6, and a circular waveguide with a tapered surface region 6*a* between the slope discontinuity 6 and the aperture 7. Region B does not contain any flat surface region having a zero slope with respect to the axis 151.

Each of the tapered surface regions 5*a* and 6*a* has a slope greater than zero and less than ninety degrees with respect to the axis 151. An angle θ1 between the axis 151 and the tapered surface region 5*a* is a positive number greater than zero and less than ninety. An angle θ2 between the axis 151 and the tapered surface region 6*a* is also a positive number greater than zero and less than ninety. Region B contains tapered surface regions having a positive slope with respect to the axis 151.

Region B generates the dominant mode TE11 as well as one or more higher modes of the TE mode (e.g., the TE12 mode, the TE13 mode, the TE14 mode, the TE15 mode, etc.).

TABLE 1

| Location | D (in.) | L (in.) | $D/\lambda_{TX}$ | $D/\lambda_{RX}$ | Tx TE modes | Rx TE modes |
|---|---|---|---|---|---|---|
| 1 | 0.472 | 0.000 | 0.732 | 1.135 | 11 | 11 |
| 2 | 0.472 | 0.150 | 0.732 | 1.135 | 11 | 11 |
| 3 | 0.660 | 0.293 | 1.023 | 1.585 | 11 | 11 |
| 4 | 0.684 | 0.732 | 1.060 | 1.642 | 11 | 11 |
| 5 | 1.044 | 1.089 | 1.619 | 2.509 | 11 | 11, 12 |
| 6 | 2.225 | 5.276 | 3.449 | 5.343 | 11, 12, 13 | 11, 12, 13, 14, 15 |
| 7 | 2.270 | 7.157 | 3.520 | 5.452 | 11, 12, 13 | 11, 12, 13, 14, 15 |

Table 1 describes the characteristics and geometries of the dual-band feed horn 150 of FIG. 15 according to one aspect of the present invention. The first column of Table 1 lists the locations along the horn 150: location 1 is the throat 1, location 2 is the slope discontinuity 2, location 3 is the slope discontinuity 3, location 4 is the slope discontinuity 4, location 5 is the slope discontinuity 5, location 6 is the slope discontinuity 6, and location 7 is the aperture 7. According to one aspect of the present invention, each of the throat 1 and the aperture 7 is not viewed as one of the slope discontinuities. According to another aspect of the present invention, each of the throat 1 and the aperture 7 is viewed as one of the slope discontinuities.

The second column of Table 1 identifies the diameter of the horn 150 at the various locations 1 through 7, measured in inches. For example, at the throat 1, the diameter of the horn 150 is 0.472 inches. At the slope discontinuity 5, the diameter of the horn 150 is 1.044, and at the aperture 7, the diameter is 2.270. The diameter of the horn 150 generally increases from the throat 1 to the aperture 7.

The third column of Table 1 identifies the length of the horn 150 at the various locations 1 through 7, by measuring the distance in inches between the throat 1 and the particular location. For example, the length between the throat 1 and the slope discontinuity 5 is 1.089 inches.

The fourth column of Table 1 identifies the ratio (or the multiplication factor) between the diameter of the horn 150 at a particular location and the wavelength of the lowest frequency of the transmission frequency band. The relationship between wavelength and frequency is as follows:

$$\lambda = c/f,$$

where λ is the wavelength of an electromagnetic wave, c is the speed of propagation of the wave, and f is the frequency of the wave.

The fifth column of Table 1 identifies the ratio (or the multiplication factor) between the diameter of the horn 150 at a particular location and the wavelength of the lowest frequency of the reception frequency band.

The sixth column of Table 1 identifies which TE mode or modes are produced at the various locations (or slope discontinuities) along the horn 150 for the transmission frequency band. The last column of Table 1 identifies which TE mode or modes are produced at the various locations (or slope discontinuities) along the horn 150 for the reception frequency band.

Referring to FIG. 15 and Table 1, the horn 150 has an aperture diameter of about 2.27 inches at location 7 and operates over the transmission frequency band between about 18.30 GHz and 20.20 GHz and the reception frequency band between about 28.35 GHz and 30.00 GHz according to one embodiment of the present invention.

The throat 1 of the horn 150 in region A produces the dominant TE11 mode in both the transmission frequency band and the reception frequency band. The diameter of the throat 1, which is about 0.472 inches, is about 0.732 times the wavelength of the lowest frequency of the transmission frequency band and about 1.135 times the wavelength of the lowest frequency of the reception frequency band.

Each of the slope discontinuities 2, 3 and 4 in region A generates the dominant TE11 mode in both the transmission frequency band and the reception frequency band. The slope discontinuities 2, 3 and 4 are used for impedance matching of the horn 150 to free space for both the transmission frequency band and the reception frequency band.

Each of the slope discontinuities 2, 3 and 4 has a diameter of about 0.472 inches, about 0.660 inches, and about 0.684 inches, respectively. Each of these diameters is related to the lowest frequency of the transmission frequency band and to the lowest frequency of the reception frequency band by the corresponding multiplication factor (e.g., about 0.732, and 1.135, about 1.023 and 1.585, and about 1.060 and 1.642, respectively).

The slope discontinuity 5 of the horn 150 in region B generates the dominant TE11 mode in the transmission frequency band and generates the dominant TE11 mode and a higher order mode of the TE mode, TE12, in the reception frequency band. The diameter of the circular waveguide at the slope discontinuity 5 is about 1.044 inches, which is about 1.619 times the wavelength of the lowest frequency of the transmission frequency band and about 2.509 times the wavelength of the lowest frequency of the reception frequency band.

The slope discontinuity 6 of the horn 150 in region B generates the TE11 mode, the TE12 mode and the TE13 mode in the transmission frequency band and generates the TE11 mode, the TE12 mode, the TE13 mode, the TE14 mode and the TE15 mode in the reception frequency band. The diameter of the circular waveguide at the slope discontinuity 6 is about 2.225 inches, which is about 3.449 times the wavelength of the lowest frequency of the transmission frequency band and about 5.343 times the wavelength of the lowest frequency of the reception frequency band.

The tapered surface region 6*a*, which is located nearest to the aperture 7 and which is the last section connected to the aperture 7, has the smallest slope with respect to the axis 151 among all of the tapered surface regions in region B (i.e., the tapered surface regions 5*a* and 6*a*).

Figure 16:
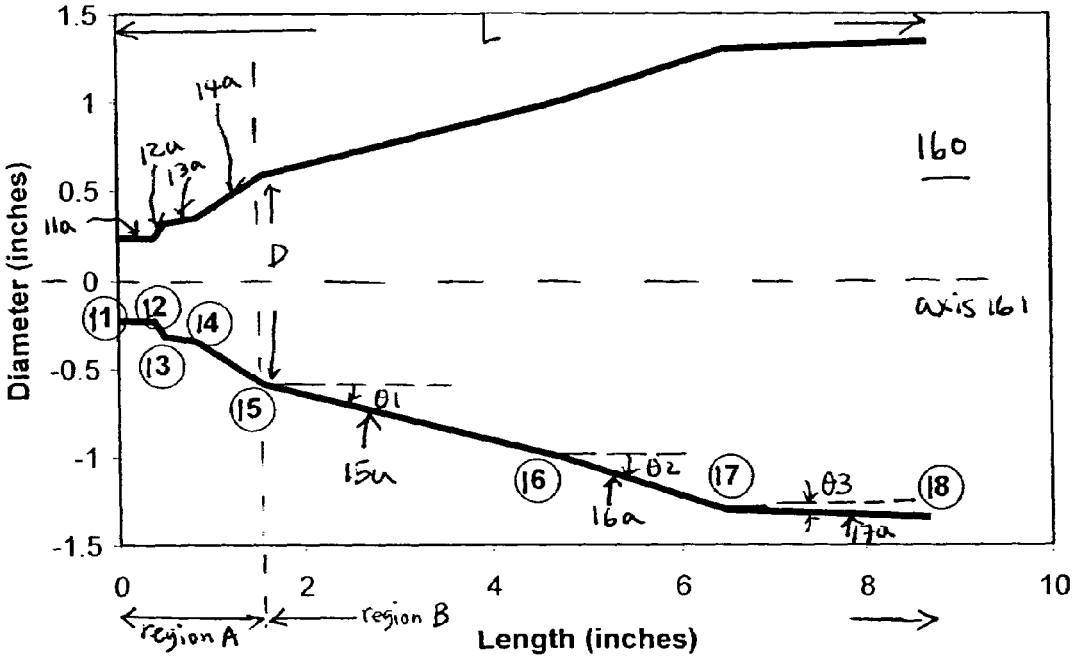
FIG. 16 illustrates another dual-band feed horn having slope discontinuities according to one embodiment of the present invention.

FIG. 16 illustrates a dual-band feed horn having slope discontinuities according to one embodiment of the present invention. A dual-band feed horn 160 is configured for providing transmission and reception of signals over respective transmission and reception frequency bands. The horn 160 includes a substantially conical wall having an internal surface with a variable slope.

The horn 160 includes a first opening at a throat 11 and a second opening at an aperture 18. It has a length along an axis 161 extending between the throat 11 and the aperture 18. The axis 161 is generally perpendicular to the cross-section of the horn 160. A length L between the throat 11 and the aperture 18 is shown, and a diameter D of the horn 160 is shown at a slope discontinuity 15.

Between the throat 11 and the aperture 18, the horn 160 includes region A connected to the first opening and region B connected to region A at one end and to the second opening at the other end.

Region A includes the throat 11, slope discontinuities 12, 13 and 14, a circular waveguide having a substantially flat surface region 11*a* between the throat 11 and the slope discontinuity 12, a circular waveguide having a tapered surface region 12*a* between the slope discontinuities 12 and 13, a circular waveguide having a gently tapered surface region 13*a* between the slope discontinuities 13 and 14, and a circular waveguide having a tapered surface region 14*a* between the slope discontinuities 14 and 15. The flat surface region 1*a* has substantially a zero slope with respect to the axis 161. Each of the tapered surface regions 12*a*, 13*a* and 14*a* has a slope greater than zero and less than ninety degrees with respect to the axis 161.

Region A generates the dominant mode of TE11. Region A, however, does not generate the higher order modes of the TE mode (e.g., the TE12 mode, the TE13 mode, the TE14 mode, the TE15 mode, the TE16 mode, the TE17 mode, etc.).

Region B includes slope discontinuities 15, 16 and 17, the aperture 18, a circular waveguide having a tapered surface region 15*a* between the slope discontinuities 15 and 16, and a circular waveguide with a tapered surface region 16*a* between the slope discontinuities 16 and 17, and a circular waveguide having a tapered surface region 17*a* between the slope discontinuity 17 and the aperture 18. Region B does not contain any flat surface region having a zero slope with respect to the axis 161.

Each of the tapered surface regions 15*a*, 16*a* and 17*a* has a slope greater than zero and less than ninety degrees with respect to the axis 161. An angle θ1 between the axis 161 and the tapered surface region 15*a* is a positive number greater than zero and less than ninety. An angle θ2 between the axis 161 and the tapered surface region 16*a* is also a positive number greater than zero and less than ninety. An angle θ3 between the axis 161 and the tapered surface region 17*a* is also a positive number greater than zero and less than ninety. Region B contains tapered surface regions having a positive slope with respect to the axis 161.

Region B generates the dominant mode TE11 as well as one or more higher modes of the TE mode (e.g., the TE12 mode, the TE13 mode, the TE14 mode, the TE15 mode, and the TE16 mode, etc.).

TABLE 2

| Location | D (in.) | L (in.) | $D/\lambda_{TX}$ | $D/\lambda_{RX}$ | Tx TE modes | Rx TE modes |
|---|---|---|---|---|---|---|
| 11 | 0.470 | 0.000 | 0.729 | 1.129 | 11 | 11 |
| 12 | 0.470 | 0.400 | 0.729 | 1.129 | 11 | 11 |
| 13 | 0.648 | 0.502 | 1.005 | 1.557 | 11 | 11 |
| 14 | 0.701 | 0.825 | 1.087 | 1.684 | 11 | 11 |
| 15 | 1.171 | 1.539 | 1.816 | 2.813 | 11, 12 | 11, 12, 13 |
| 16 | 2.008 | 4.717 | 3.114 | 4.824 | 11, 12, 13 | 11, 12, 13, 14, 15 |
| 17 | 2.600 | 6.486 | 4.031 | 6.245 | 11, 12, 13, 14 | 11, 12, 13, 14, 15, 16 |
| 18 | 2.680 | 8.703 | 4.155 | 6.437 | 11, 12, 13, 14 | 11, 12, 13, 14, 15, 16 |

Table 2 describes the characteristics and geometries of the dual-band feed horn 160 of FIG. 16 according to one aspect of the present invention. The first column of Table 2 lists the locations along the horn 160: location 11 is the throat 11, location 12 is the slope discontinuity 12, location 13 is the slope discontinuity 13, location 14 is the slope discontinuity 14, location 15 is the slope discontinuity 15, location 16 is the slope discontinuity 16, location 17 is the slope discontinuity 17, and location 18 is the aperture 18. According to one aspect of the present invention, each of the throat 11 and the aperture 18 is not viewed as one of the slope discontinuities. According to another aspect of the present invention, each of the throat 11 and the aperture 18 is viewed as one of the slope discontinuities.

The second column of Table 2 identifies the diameter of the horn 160 at the various locations 11 through 18, measured in inches. The third column of Table 2 identifies the length of the horn 160 at the various locations 11 through 18, by measuring the distance in inches between the throat 11 and the particular location.

The fourth column of Table 2 identifies the ratio (or the multiplication factor) between the diameter of the horn 160 at a particular location and the wavelength of the lowest frequency of the transmission frequency band. The fifth column of Table 2 identifies the ratio (or the multiplication factor) between the diameter of the horn 160 at a particular location and the wavelength of the lowest frequency of the reception frequency band.

The sixth column of Table 2 identifies which TE mode or modes are produced at the various locations (or slope discontinuities) along the horn 160 for the transmission frequency band. The last column of Table 2 identifies which TE mode or modes are generated at the various locations (or slope discontinuities) along the horn 160 for the reception frequency band.

Referring to FIG. 16 and Table 2, the horn 160 has an aperture diameter of about 2.68 inches at location 18 and operates over the transmission frequency band between about 18.30 GHz and 20.20 GHz and the reception frequency band between about 28.35 GHz and 30.00 GHz according to one embodiment of the present invention.

The throat 11 of the horn 160 in region A produces the dominant TE11 mode in both the transmission frequency band and the reception frequency band. Each of the slope discontinuities 12, 13 and 14 in region A generates the dominant TE11 mode in both the transmission frequency band and the reception frequency band. The slope discontinuities 12, 13 and 14 are used for impedance matching of the horn 160 to free space for both the transmission frequency band and the reception frequency band.

The slope discontinuity 15 of the horn 160 in region B generates the TE11 mode and the TE12 mode in the transmission frequency band and generates the TE11 mode and two higher order modes of the TE mode, TE12 and TE13, in the reception frequency band. The diameter of the circular waveguide at the slope discontinuity 15 is about 1.171 inches, which is about 1.816 times the wavelength of the lowest frequency of the transmission frequency band and about 2.813 times the wavelength of the lowest frequency of the reception frequency band.

The slope discontinuity 16 of the horn 160 in region B generates the TE11 mode, the TE12 mode, and the TE13 mode in the transmission frequency band and generates the TE11 mode, the TE12 mode, the TE13 mode, the TE14 mode and the TE15 mode in the reception frequency band. The diameter of the circular waveguide at the slope discontinuity 16 is about 2.008 inches, which is about 3.114 times the wavelength of the lowest frequency of the transmission frequency band and about 4.824 times the wavelength of the lowest frequency of the reception frequency band.

The slope discontinuity 17 of the horn 160 in region B generates the TE11 mode, the TE12 mode, the TE13 mode, and the TE14 mode in the transmission frequency band and generates the TE11 mode, the TE12 mode, the TE13 mode, the TE14 mode, the TE15 mode, and the TE16 mode in the reception frequency band. The diameter of the circular waveguide at the slope discontinuity 17 is about 2.600 inches, which is about 4.031 times the wavelength of the lowest frequency of the transmission frequency band and about 6.245 times the wavelength of the lowest frequency of the reception frequency band.

The aperture 18 generates the following TE modes: the TE11 mode, the TE12 mode, the TE13 mode and the TE14 mode in the transmission frequency band, and the TE11 mode, the TE12 mode, the TE13 mode, the TE14 mode, the TE15 mode and the TE16 mode in the reception frequency band. The slope discontinuity 17 (which is located nearest to the aperture 18 or which is the last slope discontinuity in region B) and the aperture 18 generate the same TE modes.

The tapered surface region 17*a*, which is located nearest to the aperture 18 and which is the last section connected to the aperture 18, has the smallest slope with respect to the axis 161 among all of the tapered surface regions in region B (i.e., θ3 of the tapered surface region 17*a* is the smallest angle among θ1, θ2 and θ3).

While FIG. 15 shows four surface regions 1*a*, 2*a*, 3*a* and 4*a* in region A and two tapered surface regions 5*a* and 6*a* in region B, and FIG. 16 shows four surface regions 11*a*, 12*a*, 13*a* and 14*a* in region A and three tapered surface regions 15*a*, 16*a* and 17*a* in region B, each of regions A and B may include any number of surface regions according to other embodiments of the present invention.

According to one embodiment of the present invention, a horn generates and propagates only the TE modes. According to one aspect of the present invention, a horn employs the TE11 mode, the TE12 mode and the TE13 modes (with the mode amplitude distribution of 1.0, 0.31 and 0.22 respectively), and uses the TE11 mode, the TE12 mode, the TE13 mode, the TE14 mode, and the TE15 mode (with the mode amplitude distribution of 1.0, 0.30, 0.19, 0.15, and 0.14, respectively). The TE1,n type modes narrow the H-plane pattern of the horn resulting in higher efficiency.

According to one embodiment of the present invention, when a horn or a section of the horn is described to generate or propagate only one mode, it indicates that the generation or propagation of the other mode or modes is insignificant (e.g., the total power of the other mode or modes in the horn or at the particular section of the horn is less than 1% of the total input power of the horn or less than 2% of the total input power of the horn). For example, when a slope discontinuity of a horn generates only the TE modes, the generation of other modes by the slope discontinuity is insignificant (e.g., the total power of the other modes is less than 1% or 2% of the total input power of the horn).

According to one embodiment of the present invention, a horn or the slope discontinuities in the horn do not generate the dominant mode of the transverse magnetic (TM) mode, the TM11 mode. This TM11 mode tapers the aperture illumination and lowers the aperture efficiency. This mode is thus not desired for a multi-beam antenna application. According to another aspect of the present invention, a horn or the slope discontinuities in the horn do not generate any of the higher order modes of the TM mode (e.g., the TM12 mode, the TM13 mode, the TM14 mode, the TM15 mode, the TM16 mode, the TM17 mode, the TM18 mode, etc.). According to another aspect, a horn or the slope discontinuities in the horn do not generate the dominant mode of the transverse electromagnetic (TEM) mode. According to yet another aspect, a horn or the slope discontinuities in the horn do not generate any of the higher order modes of the TEM mode. According to one aspect, not generating any of the TM modes indicates that the total power of the TM modes is less than 1% of the total input power of the horn. According to another aspect, not generating any of the TM modes indicates that the total power of the TM modes is less than 2% of the total input power of the horn. According to yet another aspect, not generating any of the TEM modes indicates that the total power of the TEM modes is less than 1% of the total input power of the horn. According to one embodiment, the discussion provided in this paragraph applies to the discussion provided below with reference to Table 3.

TABLE 3

| Diameter (D) at a slope discontinuity | TE modes |
|---|---|
| $1.7\ \lambda < D < 2.72\ \lambda$ | 11, 12 |
| $2.72\ \lambda < D < 3.726\ \lambda$ | 11, 12, 13 |
| $3.726\ \lambda < D < 4.731\ \lambda$ | 11, 12, 13, 14 |
| $4.731\ \lambda < D < 5.735\ \lambda$ | 11, 12, 13, 14, 15 |
| $5.735\ \lambda < D < 6.737\ \lambda$ | 11, 12, 13, 14, 15, 16 |
| $6.737\ \lambda < D < 7.739\ \lambda$ | 11, 12, 13, 14, 15, 16, 17 |

Table 3 shows the values of the diameter (D) of a slope discontinuity of a horn and the corresponding TE modes generated by the slope discontinuity and propagated according to one embodiment of the present invention. For example, to allow the TE11 and TE12 modes to be generated and propagated for a particular frequency band, the diameter of a slope discontinuity of a horn is selected to be greater than 1.7 times the wavelength of any of the frequencies of the frequency band and less than 2.72 times the wavelength of any of the frequencies of the frequency band.

For instance, if the frequency band is between 20 GHz and 40 GHz, then the diameter is greater than 1.7 times the wavelength of the lowest frequency (i.e., 20 GHz), greater than 1.7 times the wavelength of the second lowest frequency, greater than 1.7 times the wavelength of the third lowest frequency, etc., and greater than 1.7 times the wavelength of the highest frequency (i.e., 40 GHz). In addition, in this example, the diameter is less than 2.72 times the wavelength of the lowest frequency (i.e., 20 GHz), less than 2.72 times the wavelength of the second lowest frequency, less than 2.72 times the wavelength of the third lowest frequency, etc., and less than 2.72 times the wavelength of the highest frequency (i.e., 40 GHz).

To allow the TE11 and TE12 modes to be generated and propagated in a frequency band, the diameter of a slope discontinuity of a horn can be selected to be greater than 1.7 times the wavelength of the lowest frequency of the frequency band and less than 2.72 times the wavelength of the highest frequency of the frequency band. This range of the diameter satisfies the requirements set forth in the last sentence of the paragraph after Table 3.

Referring to Table 3, to allow the TE11, TE12 and TE13 modes to be generated and propagated in the frequency band, the diameter of a slope discontinuity of a horn is selected to be greater than 2.72 times the wavelength of any of the frequencies of the frequency band and less than 3.726 times the wavelength of any of the frequencies of the frequency band, or the diameter is selected to be greater than 2.72 times the wavelength of the lowest frequency of the frequency band and less than 3.726 times the wavelength of the highest frequency of the frequency band.

To allow the TE11, TE12, TE13 and TE14 modes to be generated and propagated in the frequency band, the diameter of a slope discontinuity of a horn is selected to be greater than 3.726 times the wavelength of any of the frequencies of the frequency band and less than 4.731 times the wavelength of any of the frequencies of the frequency band, or the diameter is selected to be greater than 3.726 times the wavelength of the lowest frequency of the frequency band and less than 4.731 times the wavelength of the highest frequency of the frequency band.

To allow the TE11, TE12, TE13, TE14 and TE15 modes to be generated and propagated in the frequency band, the diameter of a slope discontinuity of a horn is selected to be greater than 4.731 times the wavelength of any of the frequencies of the frequency band and less than 5.735 times the wavelength of any of the frequencies of the frequency band, or the diameter is selected to be greater than 4.731 times the wavelength of the lowest frequency of the frequency band and less than 5.735 times the wavelength of the highest frequency of the frequency band.

Still referring to Table 3, to allow the TE11, TE12, TE13, TE14, TE15 and TE16 modes to be generated and propagated in the frequency band, the diameter of a slope discontinuity of a horn is selected to be greater than 5.735 times the wavelength of any of the frequencies of the frequency band and less than 6.737 times the wavelength of any of the frequencies of the frequency band, or the diameter is selected to be greater than 5.735 times the wavelength of the lowest frequency of the frequency band and less than 6.737 times the wavelength of the highest frequency of the frequency band.

To allow the TE11, TE12, TE13, TE14, TE15, TE16 and TE17 modes to be generated and propagated in the frequency band, the diameter of a slope discontinuity of a horn is selected to be greater than 6.737 times the wavelength of any of the frequencies of the frequency band and less than 7.739 times the wavelength of any of the frequencies of the frequency band, or the diameter is selected to be greater than 6.737 times the wavelength of the lowest frequency of the frequency band and less than 7.739 times the wavelength of the highest frequency of the frequency band.

Slope discontinuities meeting the diameter requirements set forth in Table 3 generate only the TE modes and do not generate the TM modes or the TEM modes. The diameters of the slope discontinuities of the horns 150 and 160 shown in FIGS. 15 and 16 satisfy the requirements set forth in Table 3.

When a horn or a system uses the transmission frequency band and the reception frequency band, the requirements set forth in Table 3 apply to the transmission frequency band and the reception frequency band (i.e., the description with respect to Table 3 applies to the transmission frequency band as if the term "frequency band" were replaced by the term "transmission frequency band" and applies to the reception frequency band as if the term "frequency band" were replaced by the term "reception frequency band."

When a system has multiple frequency bands, the requirements set forth in Table 3 and the descriptions with respect to Table 3 apply to each of the frequency bands as if the term "frequency band" were replaced by the term "each of the multiple frequency bands." For example, to allow the TE11 and TE12 modes to be generated and propagated in each of the multiple frequency bands, the diameter of a slope discontinuity of a horn is selected to be greater than 1.7 times the wavelength of any of the frequencies of each of the multiple frequency bands and less than 2.72 times the wavelength of any of the frequencies of each of the multiple frequency bands. Alternatively, to allow the TE11 and TE12 modes to be generated and propagated in each of the multiple frequency bands, the diameter of a slope discontinuity of a horn is selected to be greater than 1.7 times the wavelength of the lowest frequency of each of the multiple frequency bands and less than 2.72 times the wavelength of the highest frequency of each of the multiple frequency bands. For the other TE modes, similar requirements apply to each of the multiple frequency bands utilizing the corresponding multiplication factors.

The transmission frequency band and the reception frequency band are not limited to 18.30 GHz to 20.20 GHz and 28.35 GHz to 30.00 GHz, respectively, and the present invention may be utilized in other ranges of frequency bands. Moreover, the present invention is not limited to dual bands, and it may be utilized in a single frequency band or multiple frequency bands greater than two frequency bands. According to one aspect, the multiple frequency bands do not overlap in frequency. According to another aspect, at least some or all of the multiple frequency bands overlap partially in frequency.

The foregoing description illustrates and describes aspects of the present invention. Additionally, the disclosure shows and describes only exemplary embodiments, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art.

The embodiments described hereinabove are further intended to explain best modes known of practicing the invention and to enable others skilled in the art to utilize the invention in such, or other embodiments and with the various modifications required by the particular applications or uses of the invention.

Accordingly, the description is not intended to limit the invention to the form disclosed herein. In addition, it is intended that the appended claims be construed to include alternative embodiments.

What is claimed is:

1. A multiple-beam antenna system, comprising:

at least one reflector, a cluster of horns for feeding the at least one reflector, a horn of the cluster of horns configured for providing transmission and reception of signals over respective transmission and reception frequency bands, the horn including a substantially conical wall having an internal surface with a variable slope, the internal surface of the substantially conical wall including a plurality of slope discontinuities, at least one of the plurality of slope discontinuities having a diameter greater than 1.7 times the wavelength of the lowest frequency of the transmission frequency band, the diameter being greater than 1.7 times the wavelength of the highest frequency of the transmission frequency band, the diameter being greater than 1.7 times the wavelength of the lowest frequency of the reception frequency band, and the diameter being greater than 1.7 times the wavelength of the highest frequency of the reception frequency band to generate one or more higher order modes of a transverse electric (TE) mode over the transmission and reception frequency bands without generating a transverse magnetic (TM) mode.

2. The system of claim 1, wherein the diameter is greater than 2.72 times the wavelength of the lowest frequency of the reception frequency band to generate a TE13 mode in the reception frequency band.

3. The system of claim 2, wherein the diameter is greater than 2.72 times the wavelength of the lowest frequency of the transmission frequency band to generate a TE13 mode in the transmission frequency band.

4. The system of claim 1, wherein the diameter is greater than 3.726 times the wavelength of the lowest frequency of the reception frequency band to generate a TE14 mode in the reception frequency band.

5. The system of claim 1, wherein the diameter is greater than 4.731 times the wavelength of the lowest frequency of the reception frequency band to generate a TE15 mode in the reception frequency band.

6. The system of claim 1, wherein the substantially conical wall contains a phasing section with a permanent slope configured to ensure that all modes add in a proper phase relationship with the dominant mode at the aperture.

7. The system of claim 1, wherein a plurality of reflectors are respectively fed by a plurality of horn clusters, and the plurality of slope discontinuities are located within inner parts of the horn and are not part of a throat or an aperture of the horn.

8. A horn for feeding an antenna reflector to provide transmission and reception of signals over respective transmission and reception frequency bands, the horn including a substantially conical wall having an internal surface with a variable slope, the internal surface of the substantially conical wall including one or more slope discontinuities, at least one of the one or more slope discontinuities having a diameter greater than 1.7 times the wavelength of the lowest frequency of the transmission frequency band, the diameter being greater than 1.7 times the wavelength of the highest frequency of the transmission frequency band, the diameter being greater than 1.7 times the wavelength of the lowest frequency of the reception frequency band, and the diameter being greater than 1.7 times the wavelength of the highest frequency of the reception frequency band to generate one or more higher order modes of a transverse electric (TE) mode over the transmission and reception frequency bands without generating a transverse magnetic (TM) mode.

9. The horn of claim 8, wherein the diameter is greater than 2.72 times the wavelength of the lowest frequency of the reception frequency band to generate a TE13 mode in the reception frequency band.

10. The horn of claim 9, wherein the diameter is greater than 2.72 times the wavelength of the lowest frequency of the transmission frequency band to generate a TE13 mode in the transmission frequency band.

11. The horn of claim 9, wherein the diameter is less than 3.726 times the wavelength of the highest frequency of the reception frequency band.

12. The horn of claim 8, wherein the diameter is greater than 3.726 times the wavelength of the lowest frequency of the transmission frequency band to generate a TE14 mode in the reception frequency band.

13. The horn of claim 8, wherein the diameter is greater than 5.735 times the wavelength of the lowest frequency of the reception frequency band to generate a TE16 mode in the reception frequency band.

14. The horn of claim 8, wherein the substantially conical wall is provided between a throat section of the horn and an aperture of the horn, and wherein a diameter of the throat section is selected to allow the throat section to generate only a dominant TE mode over the transmission frequency band.

15. The horn of claim 14, wherein the internal surface of the substantially conical wall is free from recesses all the way from the throat section to the aperture.

16. The horn of claim 14, wherein the internal surface of the substantially conical wall is free from corrugations all the way from an opening of the throat section to the aperture.

17. The horn of claim 8, wherein an entire surface of the substantially conical wall is free from flares.

18. A horn for an antenna system for generating a dominant mode of a transverse electric (TE) mode of electromagnetic wave and one or more higher order modes of the TE mode without generating a transverse magnetic (TM) mode the horn comprising:

a first opening located at a first end, a first region connected to the first opening, the first region including a first internal surface, the first region for generating only the dominant mode of the TE mode, a second region connected to the first region, the second region including a second internal surface, the second region for generating the dominant mode of the T E mode and one or more higher order modes of the TE mode without generating the TM mode, and a second opening located at a second end opposite to the first end, the second opening connected to the second region, the horn having a length along an axis extending between the first opening and the second opening, the second internal surface of the second region including one or more tapered surface regions, each of the one or more tapered surface regions having a slope greater than zero and less than ninety degrees with respect to the axis, the second internal surface of the second region lacking any flat surface region having a zero slope with respect to the axis, the second internal surface of the second region lacking any flat surface region having a ninety degree slope with respect to the axis.

19. The horn of claim 18, wherein the one or more tapered surface regions include a plurality of tapered surface regions, each of the tapered surface regions having a different slope with respect to the axis, a last one of the plurality of tapered surface regions located nearest to the second opening, the last one of the plurality of tapered surface regions having the smallest slope with respect to the axis among all of the plurality of tapered surface regions.

20. The horn of claim 18, wherein the horn is substantially conical and is for providing or receiving signals over a first frequency band and a second frequency band, and wherein the second internal surface includes one or more slope discontinuities connected to the one or more tapered surface regions, and at least one of the one or more slope discontinuities has a diameter greater than 1.7 times the wavelength of the lowest frequency of the first frequency band and greater than 1.7 times the wavelength of the highest frequency of the first frequency band to generate one or more higher order modes of the TE mode in the first frequency band.

21. The horn of claim 20, wherein the diameter is greater than 1.7 times the wavelength of the highest frequency of the second frequency band and greater than 1.7 times the wavelength of the lowest frequency of the second frequency band to generate one or more higher order modes of the TE mode in the second frequency band without generating a dominant mode of the TM mode.

22. The horn of claim 18, wherein the horn is included in a multi-beam antenna system, the multi-beam antenna system includes one or more reflectors, the first opening is a throat, and the second opening is an aperture.

23. A horn for an antenna system for generating a dominant mode of a transverse electric (TE) mode of electromagnetic wave and one or more higher order modes of the TE mode without generating a transverse magnetic (TM) mode, the horn comprising:

a first opening located at a first end, a first region connected to the first opening, the first region including a first internal surface, the first region for generating the dominant mode of the TE mode, a second region connected to the first region, the second region including a second internal surface, the second region for generating one or more higher order modes of the TE mode without generating the TM mode, and a second opening located at a second end opposite to the first end, the second opening connected to the second region, the horn having a length along an axis extending between the first opening and the second opening, the second internal surface of the second region including a plurality of tapered surface regions, a first one of the plurality of tapered surface regions connected to a next one of the plurality of tapered surface regions, each of the plurality of tapered surface regions having a different slope with respect to the axis, a last one of the plurality of tapered surface regions connected to the second opening, the last one of the plurality of tapered surface regions having the smallest slope with respect to the axis among all of the plurality of tapered surface regions.

24. The horn of claim 23, wherein the plurality of tapered surface regions include two tapered surface regions, the first one of the plurality of tapered surface regions is connected to the first region, the second one of the plurality of tapered surface regions is the next one of the plurality of tapered surface regions, and the second one of the plurality of tapered surface regions is the last one of the plurality of tapered surface regions.

25. The horn of claim 23, wherein the horn is for providing or receiving signals over a first frequency band and a second frequency band, the first frequency band being higher than the second frequency band, wherein the second internal surface includes a plurality of slope discontinuities, each of the plurality of slope discontinuities connected to a corresponding one of the plurality of tapered surface regions, wherein at least one of the plurality of slope discontinuities has a diameter greater than 1.7 times the wavelength of the lowest frequency of the first frequency band and greater than 1.7 times the wavelength of the highest frequency of the first frequency band to generate one or more higher order modes of the TE mode in the first frequency band, wherein the diameter is greater than 1.7 times the wavelength of the highest frequency of the second frequency band and greater than 1.7 times the wavelength of the lowest frequency of the second frequency band to generate one or more higher order modes of the TE mode in the second frequency band without generating a dominant mode of the TM mode.

26. The horn of claim 23, wherein the horn is included in an antenna system, and wherein the antenna system includes a plurality of reflectors and a plurality of horn clusters for respectively feeding the plurality of reflectors to enable each of the plurality of reflectors to support both signal transmission and reception, and wherein the plurality of horn clusters includes the horn.

* * * * *